US006107614A

United States Patent [19]

Linn et al.

[11] Patent Number: 6,107,614

[45] Date of Patent: Aug. 22, 2000

[54] CONTINUOUS MICROWAVE FURNACE HAVING A PLURALITY OF FURNACE MODULES FORMING AN IMPROVED HEATING CONFIGURATION

[75] Inventors: Horst Linn; Jürgen Suhm, both of Eschenfelden, Germany

[73] Assignees: HED International Inc., Ringoes, N.J.; Linn High Therm, Germany

[21] Appl. No.: 09/195,513

[22] Filed: Nov. 19, 1998

[51] Int. Cl.[7] ..... H05B 6/78

[52] U.S. Cl. ..... 219/700; 432/244

[58] Field of Search ..... 219/698–701; 432/244

[56] References Cited

U.S. PATENT DOCUMENTS

| | | | |
|---|---|---|---|
| 3,699,899 | 10/1972 | Schiffmann et al. | 99/333 |
| 4,289,792 | 9/1981 | Smith | 426/241 |
| 4,365,422 | 12/1982 | Kawaguchi | 34/259 |
| 4,441,003 | 4/1984 | Eves, II et al. | 219/700 |
| 4,622,228 | 11/1986 | Ikeuchi et al. | 426/241 |
| 4,631,380 | 12/1986 | Tran | 219/697 |
| 4,746,968 | 5/1988 | Wear et al. . | |
| 4,764,102 | 8/1988 | Takahashi | 425/466 |
| 4,839,485 | 6/1989 | Koch et al. | 219/700 |
| 5,367,147 | 11/1994 | Kim et al. | 219/698 |
| 5,514,853 | 5/1996 | Viet | 219/700 |

FOREIGN PATENT DOCUMENTS

| | | |
|---|---|---|
| 0016699 | of 0000 | European Pat. Off. . |
| 0136453A1 | of 0000 | European Pat. Off. . |
| 196 43 989A1 | of 0000 | Germany . |
| GM1818464 | of 0000 | Germany . |

OTHER PUBLICATIONS

DE–B:E. Pehl "Mikrowellentechnik", vol. 1, 1988 Dr. A. Huthig, Verlag Heidelberg, pp. 148 to 151.

Dez; iew 49, 1991, vol. 3, pp. 149–155, Mikrowellenerwarmung–Anwendungen In Der Industries by G. Orth & J. Walter.

*Primary Examiner*—Teresa Walberg
*Assistant Examiner*—Jeffrey Pwu
*Attorney, Agent, or Firm*—Sperry, Zoda & Kane

[57] ABSTRACT

A continuous microwave furnace (10) with furnace modules (12) is described, which modules, in a series of sequential placement, one after the other, form a heated zone. On the respective housing casing (14) is provided at least one microwave radiating source (30) located at a corresponding radiation window (31). In each respective furnace module (12) a sheet steel bottom (26) is furnished, this being adjustable as to height and is constructed with secondary radiating openings (28). In the continuous microwave furnace (10) is provided a transport apparatus (33), which is constructed of a conveyor belt or transport rollers. Air openings (35) can be supplied, neighboring the radiation window (31) of the respective microwave radiation source (30). The respective radiation source (30) is then combined with an air regulating apparatus (45). A microwave deflection device (52) can be correlated with the radiation window (31) of the respective microwave source (30) in the interior of the corresponding furnace module (12). The microwave radiation source (30) can be combined with a wave guide (62). The bunching of the microwave radiation is accomplished in this last named case by means of recesses (64) in the housing casing (14) of the furnace module (12), which recesses are provided in the area of the return conductor duct (62).

49 Claims, 3 Drawing Sheets

Figure 1:
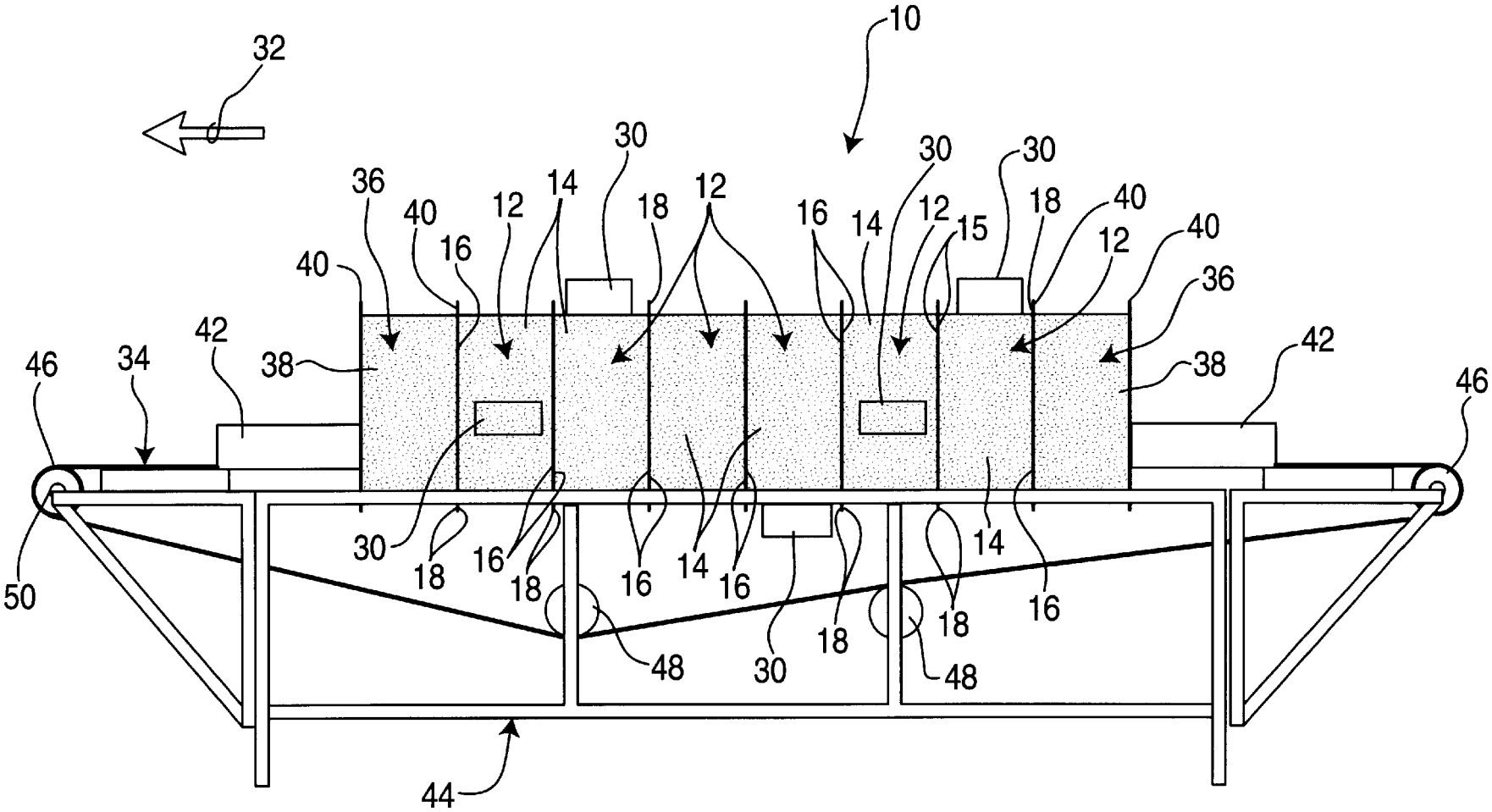

CONTINUOUS MICROWAVE FURNACE HAVING A PLURALITY OF FURNACE MODULES FORMING AN IMPROVED HEATING CONFIGURATION

The invention is concerned with a microwave, continuous furnace, in which furnace modules, which are arranged in a sequence, one after the other, form heating zones. Each furnace module possessing a housing with an integral housing casing, whereby:

on the respective housing casing, at least one microwave radiation source is provided, in the respective housing casing a sheet metal bottom is placed which is designed with holes or slots and a conveyor belt conveyor extending through the microwave continuous furnace.

A continuous microwave furnace of this kind has been made known by U.S. Pat. No. 4,746, 968.

Continuous microwave furnaces of this type were used in the ceramic industry for the drying of ceramic objects, also in the powdered metal industries for breaking up agglomerates and drying, again used in the pharmaceutical field, in the supply of raw materials, and further in the chemical industry. The known microwave continuous furnaces have been designed with a square or rectangular housing, whereby the outside measurements of the housing are so dimensioned, that the electromagnetic waves present in the said housing, generate the corresponding microwave radiating sources. The construction of such square or rectangular housings is, from the standpoint of production technology, relatively costly, which correspondingly has its effect upon the manufacturing expenses of such known continuous microwave furnaces.

In the case of the known continuous microwave furnaces, designed in accord with the said U.S. Pat. No. 4,747,968, perforated steel plates does not serve as secondary radiating means, that is, no influences on the reflected microwave emanations are activated by means of this perforated plate.

Contrarily, the perforated plates function in this case as thermal radiators.

Perforated plates in resonators, where the matter revolves around microwave heating spaces, have become known from the DE-B: E. Pehl, "Microwellentechnik", Volume 1, 1988 Dr. A. Hüthig, Verlag Heidelberg, Pages 148 to 151. These perforated plates serve for the bunching of microwave energy in the microwave heating space.

DE-GM 18 18 464 brought into common knowledge, a continuous microwave furnace with a high frequency type, long extended, working space, closed on all sides and having a conveyor belt for the objects to be treated. With this known continuous microwave furnace, the objects, in train with the motion of the conveyor belt, move one after the other through varying fields of different frequency. In case of a drying process, in the operative space and in a forward progressive movement, the object is subjected to microwave energy of increasing frequency. Where a heating procedure is involved, the operative space through which the object passes provides microwave energy of declining frequency. The microwave energy of the radiation source is, in that case, fed into the open space through windows into the furnace enclosure, that is, perforated sheet metal serves essentially as input gaps for the microwave energy entry into the operational space of the continuous microwave furnace.

Another continuous microwave furnace is made known by EP 0 016 699, wherein antennae are exhibited within the furnace space. These antennae provide means for the dissemination of the microwave field. The antennae, consequently, influence the distribution of the microwave field. Perforated plate, however, is not provided in this case. This known continuous microwave furnace, in two sections, which are remote from one another, is provided with a radiation absorber module.

Continuous microwave furnaces, which are provided with a radiation absorber module on their two end sections, which ends are remote from one another, are also made known by DE-Z; iew 49, 1991, Vol. 3, Pages 149–155, "Microwellenerwärmung—Anwendungen in der Industrie" by G. Orth and J. Walter.

The illustration "2" and the corresponding description therein, indicate neighboring ferrites, in order to avoid the emanation of microwave radiation which could be hazardous to personnel.

A continuous microwave furnace has also been made public by DE 196 43 989 A1. This known continuous microwave furnace exhibits a circular housing casing. A continuous microwave furnace with a circular housing is also the subject of the invention in EP 0 136 453 A1.

THE PURPOSE OF THE INVENTION

This present invention has the purpose of creating a continuous microwave furnace which, in a mechanical, electrical and microwave technologic manner, makes possible a relatively simple optimization at the site of operation.

This purpose will be achieved in accord with the invention by a continuous microwave furnace of the type described in the introduction, in that:

the belt conveyor lies upon a sheet metal bottom which forms a common level in the furnace module, or instead of the belt conveyor, conveyor rolls are mounted in the holes, which form a common level, and that the said holes are so located that they provide secondary radiation, and that the housing casing is circular in cross-section.

Each housing casing is provided with at least one microwave radiation source, wherein the respective microwave radiation source is installed to fit on the corresponding housing casing, in order to allow the radiation of a corresponding microwave radiation source to emanate into the attendant furnace module. At least one transformer is assigned to one respective microwave radiation source. The loss, i.e. the heat emitted from the respective microwave radiation source and from each transformer is advantageously conducted into the continuous furnace. By this means, the over-all degree of efficiency is increased.

The provision of heat insulation on the outside of the circular housing casing of each furnace module serves also toward this same purpose of efficiency.

The metal bottom of the respective furnace module can be made out of any appropriate metal sheet. In this respect, aluminum or stainless steel, or the like can be considered.

If the continuous microwave furnace, in accord with the present invention, is designed with a conveyor belt, then this is situated tightly and close fitted on a sheet metal bottom which forms a common plane in the furnace modules which are disposed, one behind the other. By this means, there arises not only a radiation effect of the microwave emission, which emanates from at least one microwave radiation source of each furnace module. But also a radiation effect from the secondary emitter, i.e. the so called slot-radiation engendering perforations in individual sheet metal bottoms of the furnace modules which modules are sequentially located, one after the other. The perforations can be formed as elongated slots, as cross or star shaped cutouts or yet as cornered or round holes. These perforation can be separated by equal spatial intervals from one another, that is, be provided as a raster grating. In the case of the elongated slots, conveyor rolls may be anchored therein. Such conveyor rolls can be made of aluminum oxide, quartz, Teflon®, or of other microwave transparent material.

In order to position the individual sheet metal bottoms and the conveyor rolls of the sequentially placed furnace modules simply and precisely in the respective corresponding housing, it is to the purpose, if, in the respective housing, support elements are provided for the correlated sheet metal bottoms. Structural shapes can be employed, where these support means are concerned, which are affixed in the interior of the corresponding housing. Attachment of the supports may be done by welding, screw connection, or riveting.

Preferentially, the holes in the respective sheet metal bottoms exhibit a constant spatial interval, one from the other. In this way, the holes can be advantageously be set apart from each other at equal intervals in the direction of conveyor travel as well as vertically thereto.

The most preferable spacing exists when the said intervals correspond to one half of the wave length of the microwave radiation of the corresponding microwave radiation source. By means of such dimensioning, a general optimization of the secondary radiation arises and thereby, also of total microwave radiation. It is also serves this same purpose, if the holes in the sheet steel bottom exhibit dimensioning, which is one-half the wave length of the microwave radiation of the respective microwave radiation source. Likewise, the said spatial interval can also be one-fourth or three fourths of the wave length or the wavelength itself, or a multiple thereof The holes in the respective sheet metal bottoms, can, as said, be shaped in design as crosses or stars, or the like. In the case of such a design of the latter mentioned kind, experience has shown that if the holes are provided inclined toward the conveyor travel direction, the angle of said inclination can be 45°. Obviously, other angles are possible.

Corresponding to the respective application, that is, the characteristics of the individual demand, the holes in the respective sheet metal bottom may be designed to be round, oval, or with corners, or preferably rectangular. Obviously it is also possible, to design the holes in the sheet metal bottom in other forms, as has already been mentioned. If the holes be designed as elongated slots, then conveyor roll anchorages can be inserted into the said slots. In the same way, it is possible to do away with the sheet metal bottom altogether, and only provide the conveyor rolls, as stated above.

The individual furnace modules which form heating-zones, are simple and time sparing when assembled in sequence, one behind the other, especially when each module possesses a ring flange on each of its exposed ends. Each ring flange can be designed with bolt holes through which threaded elements can be inserted. The ring flanges can be so designed, that between neighboring furnace modules, a gas tight sealing means as well as a microwave radiation blockage can be placed.

The said ring flanges can be designed also with furnace support elements. These supports and the support means mentioned in the introduction as provided for the sheet metal bottom are so fitted in coordination with one another, that it brings about an exact positioning of the housing and thus also the furnace module which forms the heating-zone, whereby, at the same time, the sheet metal bottoms in a row of sequentially placed furnace modules lie in a common, horizontal plane. The continuous microwave furnace, in accord with the invention, can also exhibit a chamber which is constructed at an incline.

In the case of the continuous microwave furnace in accord with the invention, it is preferred, if the belt conveyor is designed as a microwave transparent endless belt, that the turnaround be made with turn-around rolls. The turn-around rolls can be provided outside of the continuous microwave furnace and be connected with a drive apparatus. In a toxic area, i.e. in a nuclear area, the turn-around rolls can also be placed inside the furnace, in order to build a totally self contained system.

In order to expose to microwave radiation material suitable to be so radiated and being transported through the said furnace for heating purposes, provision can be made for the microwave radiation sources to be staggered in a row of furnace modules, one behind the other and advantageously equidistantly placed. In this way, the microwave radiation sources of the furnace modules have respectively, the same loading or different loadings. The loadings of the single microwave radiation sources can, for instance, vary between 600 W and 3000 W. Different loading capabilities are especially advantageous, when the continuous microwave furnace in the direction of the conveyor motion, should match, at a given moment, the material quantity through-put with a definite temperature and/or energy profile. Contributing to this purpose, an orifice-like separation of the zones is carried out. This can be designed with plain or perforated sheet metal. By means of the modular construction, the continuous microwave furnace provides the advantage of a simple accommodation to each required application demand.

It is advantageous to have a radiation absorber respectively before the first and after the last (in transport direction) furnace module of the continuous microwave furnace. The radiation absorber modules for this end placement are, in this case, preferentially similarly shaped to the furnace module, that is, they possess in each case a circular housing matching the furnace module, even to ring flanges on the exposed ends but without being equipped with the customary microwave radiation sources.

An "Absorber Tunnel" is connected to the radiation modules which are respectively located at each end of the continuous microwave furnace. A design of the continuous microwave furnace in accord with the invention, was so conceived, that the outward emanation of microwave radiation from the continuous microwave furnace did not overstep a specified threshold.

The furnace module and the end located radiation absorber modules can be positioned on a open structural framework. With such a framework available, the turn-around rolls of the conveyor belt can be advantageously supported thereon.

The given purpose of the invention can be achieved, in accord with the invention,

- in that the sheet metal bottoms of the furnace module are adjustable as to height and/or
- in that air exhaust ports are in a neighboring situation to the radiation window of the respective microwave source in the housing, whereby the respective radiation source is combined with an air regulating apparatus and/or
- in that a microwave directive and distribution apparatus is applied to the respective microwave radiation source in the interior of the respective furnace module.

By means of the ability to adjust the height of the sheet metal bottom of the furnace module, it becomes possible, in a simple way, to improve the field energy and energy distribution in the interior of the continuous furnace. This feature is a basis of a increase in the degree of efficiency of the continuous microwave furnace in accord with the invention.

To the same purpose, i.e. an increase in the degree of efficiency, the end is particularly served, when, in the case of the continuous microwave furnace, air ports are placed in a neighboring position to the respective microwave radiation source in the housing casing. By this means, the respective radiation source is combined with an air regulating apparatus. With the aid of the air regulation apparatus, it is possible, again in a simple way, to direct the air, in a desired quantity and heated by the microwave radiation source, specifically through the air ports into the interior of the furnace and in this manner, make use in the continuous furnace of at least a portion of the generated heat from the respective microwave radiation source. Again in this connection—as is obvious—a corresponding increase of the overall degree of efficiency is possible. An improvement of the on-site optimization and energy distribution in the interior of the continuous furnace is also possible in that the mentioned microwave deflection and distribution apparatus is applied to the respective micro radiation source in the interior of the respective furnace module. With the aid of the said microwave deflection apparatus, it becomes possible to impart an optimal twist to the emanating micro wave radiation issuing from the radiation window into the interior of the continuous furnace, thus again achieving an on site optimization.

In regard to the continuous microwave furnace, in accord with the invention, the sheet metal bottoms of the individual furnace modules are height adjustable even when separated, one from the other. However, it is preferable if the said bottoms are simultaneously adjusted as to height. The said bottoms are also inclinable.

The sheet metal bottom of the continuous microwave furnace in accord with the invention can be constructed as a uniformly flat plane. However, it is also possible, that the said bottoms can be domed convexly or concavely, in order, in this way to simulate a lens action of the microwaves and thus achieve a field optimization in the furnace interior favoring the material being heated in the continuous microwave furnace.

It is advantageous if the respective microwave radiation source is provided in a housing for the radiation source, which spans the radiation window and the air exhaust ports.

This individual housing is recommendable when a fan is installed for cooling the microwave source, and when the radiation source housing possesses for the realization of the air regulation apparatus an exhaust opening with a regulator. This regulator, in this case, can be designed as a sliding device or as a rotating apparatus. With the assistance of the furnished regulating device it is possible to subdivide the air quantity issuing from the blower into a specified air quantity portion to flow through the air ports into the furnace and into a another portion of the flow which exits through the air vent opening. This is achieved by the air regulation apparatus. According to the size of the optionally installed open vent cross-section opening, regulation is provided for that portion of air, which flows through the air ports.

The deflection apparatus assigned to the radiation window can be designed as a two or three dimensional air deflection body. In a two dimensional deflection apparatus, a flat or a domed plate element can be involved. In the case of the three dimensional deflection apparatus, then a sphere, a pyramid or the like is involved. The deflection body can be designed as adjustable, that is, in relation to the associated radiation window. Where a three dimensional deflection body is involved, for instance the apex angle of the cone or the pyramid can be adjustable. Thus a desirable field optimization and energy distribution can be realized.

The deflection body can be made from a conducting, reflexible metal. It can also be fabricated from a ceramic material variable in conductance and partially of absorbent characteristics. Other material can be silicon carbide, ceramically bound silicon carbide, ferrite material, partially microwave absorbent ceramic or glass. With such materials, partial microwave absorption can take place.

As to the continuous microwave furnace, in accord with the invention, a further possibility is possible, in that an the housing of the respective furnace module, a wave guide channel can be provided which is combined with the microwave radiation source, and that the housing, along the wave guide channel, is designed with secondary radiation engendering indentations.

The said wave guide channel extends, in this case, advantageously circumferentially around the housing of the furnace module. The indentations arranged in the wave guide channel which is designed in the furnace module housing casing, can be slot shaped, cross shaped or the like.

The wave guide channel can extend itself circumferentially around the housing of the respective furnace module, although it is yet possible, that the wave guide channel only runs along a sector of the circumference of the housing.

Figure 2:
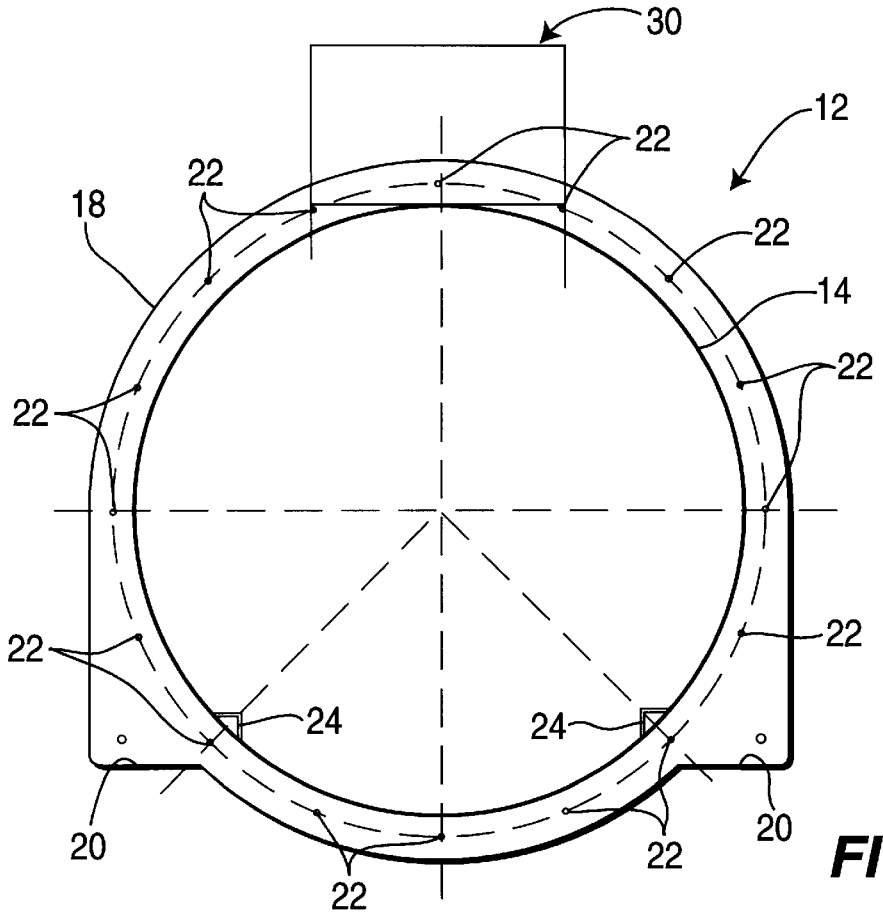
Figure 3:
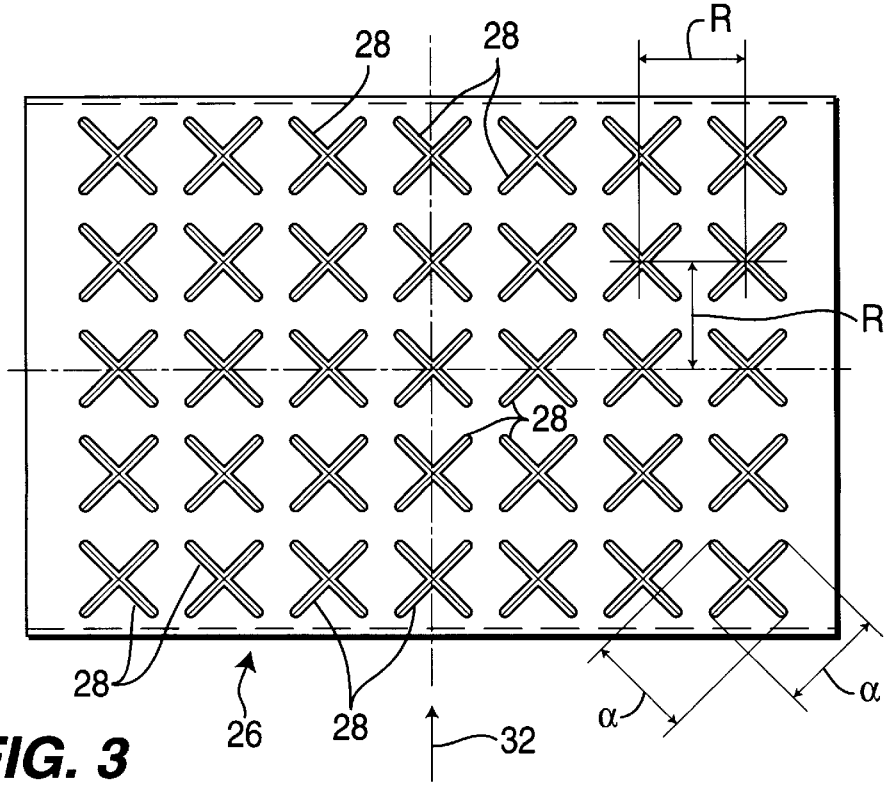
Figure 4:
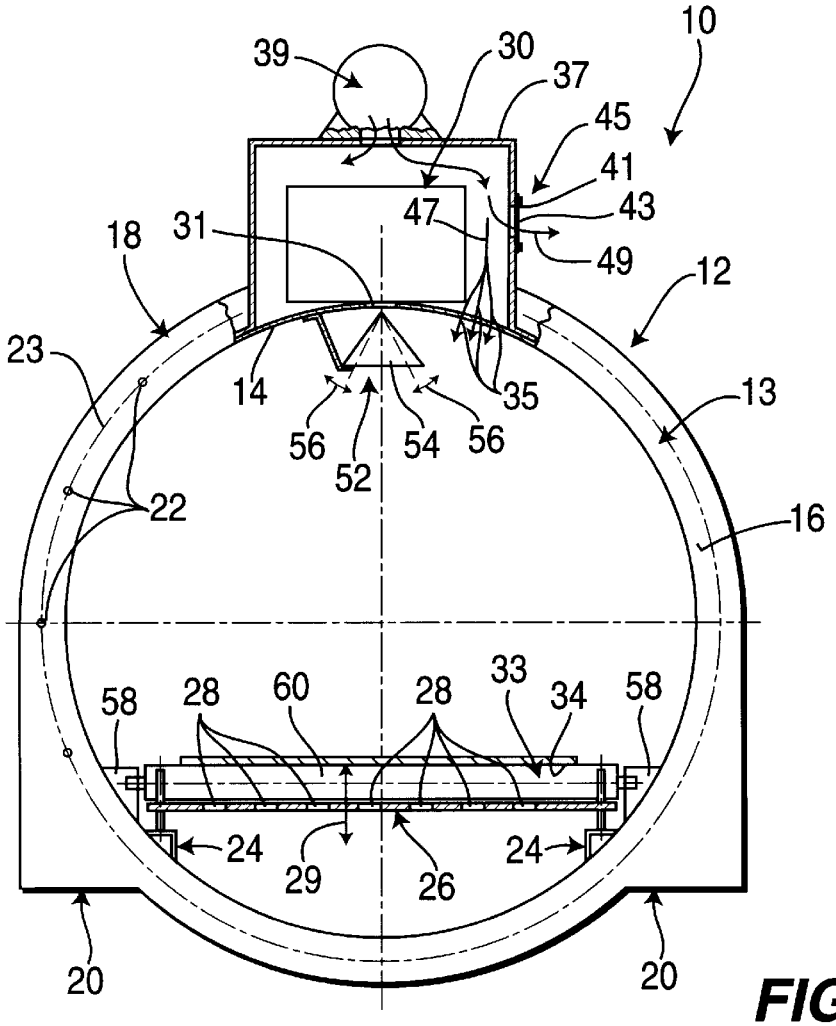
Figure 5:
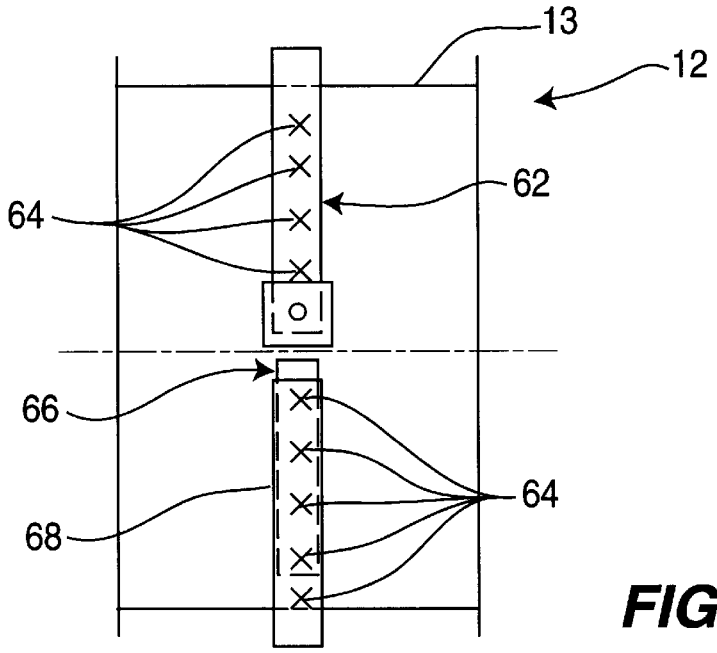

The indentations can at least extend along a partial section of the associated wave guide channel, although the said indentation can run through the entire length of the respective wave guide channel. For optional adjustment of the field distribution in the respective furnace module, the said recesses in the housing, i.e. in the wave guide channel, can be arranged in a tuning apparatus. This tuning apparatus can be made from at least a sliding device. In this case, there is involved a so-called shorting plunger Examples of embodiments of the continuous microwave furnace, in accord with the invention, are presented in the drawings and will be, in the following, described in greater detail with the help of said drawings. There is shown in:

FIG. 1 a side view of an embodiment of the continuous microwave furnace,

FIG. 2 a front view of an furnace module of the continuous microwave furnace in accord with FIG. 1, FIG. 3 a plan view of a sheet metal bottom of an furnace module of the continuous microwave furnace in accord with FIG. 1, FIG. 4 a partially sectioned front view of an furnace module of the continuous microwave furnace, and FIG. 5 a schematic representation in a view from above of an furnace module with a microwave radiation source and an associated wave guide channel on the housing casing of the furnace module.

FIG. 1 shows, schematically in a side view, a design of the continuous microwave furnace 10, which possesses furnace modules 12 which latter are arranged in a row, one behind the other. As may be inferred from FIG. 2, each furnace module exhibits a circular housing casing 14. Each casing 14 is provided with a (not shown) heat insulation layer and on the two ends 16 of said furnace module, constructed with a ring flange 18. Each ring flange 18 is designed with a supporting means 20. Besides these features, each ring flange 18 is made with fastening bolt holes 22, which are provided, equally spaced, along a concentric circle as may be seen in FIG. 2. Threaded bolts, for instance, may be inserted into the bolt holes 22 and pulled up tight, in order to make a gas-tight and microwaveproof connection with the adjacent furnace module 12.

In the interior of the respective casing 14, support elements 24 are installed, which serve for support of a sheet metal bottom 26 and/or for the support of (not shown) conveyor rolls of quartz, aluminum oxide, Teflon®, or the like. One construction of a sheet metal bottom 26 is presented in FIG. 3 in a view from above. The respective sheet metal bottom 26 is designed with perforations 28, which are aligned in two mutually vertical space directions from one another, respectively making a constant raster offset R. It is advantageous when the raster offset R corresponds to half the wave length of the microwave radiation from the microwave radiation source 30, (see FIG. 1). The said offset can also be n/4 of the wave length, wherein n is a whole number, that is, n=1, 3, 4, . . . , n. The microwave radiation sources 30 are advantageously made from known magnetrons, which are in mutual connection with transformers.

The FIG. 1 makes clear, that the microwave radiation sources 30 provided in a row of furnace modules 12, arranged behind one another are staggered in circumferential direction about the continuous microwave furnace 10 by 90°. By means of such an arrangement, the microwave radiation sources 30 give rise to a quasi helical shaped orientation of microwave radiation in the interior of the continuous microwave furnace 10.

Each furnace module 12 can also be provided with more than one microwave radiation source.

FIG. 3 makes clear a construction of a sheet metal bottom 20 with cross shaped holes 28. One sees further, from FIG. 3 that the cross shaped holes are provided in a steeply inclined angle of 45° to the direction of a transport belt 34 as shown by the arrow in FIGS. 1 and 3, which belt—as seen in FIG. 1—extends completely through the continuous microwave furnace 10. The open slots of the holes 28, which cross over themselves, show a dimension of a, which advantageously corresponds to the half or a whole number multiple of the fourth part of the wave length of the microwave radiation of the respective microwave radiation source 30. The holes 28 form, by means of such dimensioning, a secondary or a split beam radiation means.

In the transport direction of the conveyor belt, 34, which is designed as an endless belt, there is before the first furnace module 12 and after the last furnace module 12, there is respectively provided at least one radiation absorber module 36 (see FIG. 1). The radiation absorber modules 36 provided on the ends are similar to the furnace module 12 with a circular housing 38 and designed with ring flanges 40, as well as with the internal support elements and with the external supports to rest on the framing, as they are seen in FIG. 2, designated with the reference number 20. Each of the two end side radiation absorber modules 36 is, beyond this, designed with an absorber tunnel. By means of such design, vagabond microwave radiation is reduced to less than the specified threshold value.

The furnace module 12 and the two furnace end located radiation absorber modules 36 are placed on a structural furnace framing 44. On this furnace framing 44 are found also the turn-around rolls 46 and the belt tensioning rolls 48 which keep the endless conveyor belt tight during operation. One of the turn-around rolls 46 is functionally connected to a drive apparatus 50. This drive apparatus can be, for instance, an electric motor which is combined with a gear drive.

FIG. 4 shows a partially sectioned front view of a continuous microwave furnace 10, or a furnace module 12 thereof, whereby the furnace modules 12 are placed in a row, one behind the other, and constitute the heating zones of the said continuous microwave furnace 10. Each furnace module 12 of the continuous microwave furnace 10 exhibits a housing 13 with a circular casing 14. On the axially, mutually remote ends 16 of the casing 14 of the respective furnace module 12, ring flanges 18 are provided, by means of which, adjacently disposed furnace modules 12 can be connected together forming the continuous microwave furnace 10. Each ring flange 18 includes the furnace support structure 20 and the said flanges are also provided with bolt holes 22. The bolt holes 22 are equally distributed on a concentric bolt circle 23 of the flange 18. In FIG. 4 only some of these bolt holes 22 are made visible.

In the interior of the respective furnace module 12, support elements 24 are installed and serve for the support of the associated sheet metal bottom 26, which in turn is supplied with holes 28. The respective sheet metal bottom 26 is adjustable as to height. This adjustability in respect to height of the respective sheet metal bottom 26 is emphasized by the double headed arrow 29.

On the casing 14 of the respective furnace module 12 of the continuous microwave furnace 10, is installed at least one microwave radiation source 30 with an associated radiation window 31 in the casing 14.

A transport apparatus 33 extends completely through the continuous microwave furnace 10, which serves for the carrying of the material to be treated in the continuous microwave furnace 10. In FIG. 4 is shown a conveyor belt system 34 which forms the transport apparatus 33. The transport apparatus 33 can also be constituted of transport rollers, which are set into the holes 28 of the sheet metal bottom 26 of the furnace module 12 of the continuous microwave furnace 10.

The transport, or conveyor belt 34 is supported on the sheet metal bottom 26 of the furnace module 12, which bottom forms a common plane.

In the casing 14, air furnace inlet air ports 35 are placed in proximity to the radiation window 31 of the respective microwave radiation source 30. The respective microwave radiation source 30 is provided in a radiation source housing 37, which spans the radiation window 31 and the air ports 35. A blower 39 is mounted on the radiation source housing 37 for the cooling of the microwave radiation source 30, which can be constructed from a conventional commercial magnetron. The radiation source housing 37 exhibits an exhaust opening 41, for which a regulator element 43 has been installed. The regulator element 43 can be a slide gate or a rotary operated control. The said regulator 43 forms, in common with the exhaust opening 41, an air control apparatus 45 in the radiation source housing 37, with the help of which it becomes possible to direct the air flow, which is pulled in from outside by the blower 39 and, as it cools, circulates within the microwave radiation source 30, then subdividing into a first partial flow which exits through the air exhaust 41 and into a second flow guided by the air control apparatus 45. The first partial flow direction is made clear by the arrow 47 and the second air flow is shown by the arrow 49.

In the radiation window 31 of the respective microwave radiation source in the interior of the respective furnace module 12, is located a microwave deflection apparatus 52 with the aid of which an on site option is made possible in the interior of the respective furnace module 12 and thus, also possible in the interior of the continuous microwave furnace 10.

The respective microwave deflection apparatus 52 can be designed as a two or three dimensional deflection body 54. In the FIG. 4, a conical shaped deflection body 54 is depicted. The deflection body 54 can be changed in its form as it is designed to be adjustable. This is indicated by the two bow-shaped double arrows 56. In this alteration, the apex angle of the conical deflection body 54 is adjusted. This fact is indicated by the thin, dotted lines. In similar way, it is possible, that the said deflection body 54 can be adjusted in a radial direction.

FIG. 4 illustrates, moreover, the support elements 58, which lie opposite to one another in the interior of the housing 13 of the furnace module 12.

On these support elements 58, a roll is turnably supported.

The conveyor belt 34 of the transport apparatus 33 lies upon the rolls 60 of the continuous microwave furnace 10. The rolls 60 are secured at an unchangeable height, while the respective sheet metal bottom is designed to be adjustable as to height, as is indicated by the double ended arrow 29. Instead of rolls 60, it is also possible to provide a simple rod, upon which the conveyor belt 34 of the transport apparatus 33 can glide.

By means of the possibility of adjusting the spatial offset between the conveyor belt 34 of the transport apparatus 33 and the sheet metal bottom 26, the opportunity arises to optionally interact with the microwaves in the interior of the housing 13 of the respective module 12 of the continuous microwave furnace 10, in order to change the field distribution to correspond to the current conditions.

FIG. 5 presents schematically an furnace module 12 with a circular, cylindrical housing casing 14, on which a microwave radiation source 30 is mounted. The microwave radiation source 30 is combined with a wave guide 62, which extends itself along the circumference of the furnace module 12, i.e. the housing 13 thereof The microwaves generated by the microwave radiation source are bunched in the said wave guide 62. The wave guide serves to guide the microwave radiation. In the area of the wave guide 62, the housing 13 is equipped with indentations 64, which become secondary radiation means. The indentations 64 can be formed slot shaped, cross shaped or the like. In FIG. 5, cross shaped indentations are illustrated. With the aid of the secondary radiation generation from the indentations 64, it is possible to achieve an optional, uniform microwave field distribution.

The circumferential section of the housing casing 14, thus also of the wave guide 62, along which indentations 64 are provided, can be formulated in various ways. To this purpose, a tuning apparatus 66 can be provided for the indentations 64 in the housing casing 14, as well as in the wave guide 62, which would be regulated by a sliding device 68.

In the case of the continuous microwave furnace 10, the furnace modules 12 can be sequentially aligned linearly in a row behind one another. However, it is also possible, that the furnace module 12 can be placed in a bowed or circular shape, also behind one another in a sequence.

DRAWING REFERENCE NUMBERS

| No. | Description |
|---|---|
| 10 | Continuous microwave furnace |
| 12 | Furnace module |
| 13 | Housing |
| 14 | Housing casing |
| 16 | Fwd. side of 12 |
| 18 | Ring flange on 16 |
| 20 | Support structure of 18 |
| 22 | Securement holes in 18 |
| 23 | Circle segment for 22 |

-continued

DRAWING REFERENCE NUMBERS

| No. | Description |
|---|---|
| 24 | Support elements for 26 |
| 26 | Sheet metal bottom |
| 28 | Holes in 26 |
| 29 | Double arrow |
| 30 | Microwave source on 14 |
| 31 | Radiation window in 14 |
| 32 | Transport direction |
| 33 | Transport apparatus |
| 34 | Conveyor belt |
| 35 | Air ports in 14 |
| 36 | Radiation absorber mod |
| 37 | Radiation source housing |
| 38 | Housing casing (cylindrical part) |
| 39 | Blower (on 37) |
| 40 | Ring flange |
| 41 | Exhaust opening |
| 42 | Absorber tunnel |
| 43 | Regulator element |
| 44 | Furnace support structure |
| 45 | Air control apparatus |
| 46 | Turn-around roll |
| 47 | First partial flow thru 37 |
| 48 | Belt tension rolls |
| 49 | Second partial flow |
| 50 | Drive apparatus |
| 52 | Microwave deflector. |
| 54 | Deflector body from 52 |
| 56 | Double arrow (bowed) |
| 58 | Support elements |
| 60 | Rolls |
| 62 | Wave guide channel |
| 64 | Indentation(s) |
| 66 | Tuning apparatus |
| 68 | Slide mechanism |

What is claimed is:

1. A continuous microwave furnace having a plurality of furnace modules forming heating zones arranged sequentially behind one another for heating articles conveyed therethrough, said continuous microwave furnace comprising:

A. a plurality of furnace modules positioned adjacent to one another to mutually define a heating area therealong, each of said furnace modules including:

(1) a housing means defining a heating zone therewithin;

(2) a housing casing secured to said housing means, each housing casing including a case wall having a circular cross-section;

B. a plurality of microwave radiation sources each being attached to one of said housing casings adjacent one of said housing means and adapted to generate microwave radiation for transmitting into said housing means thereadjacent for heating therewithin, at least one of said microwave radiation sources being provided at said case wall;

C. a metallic bottom sheet member mounted within said heating zone of said housing means and defining a plurality of hole means therein for enhancing microwave radiation within said heating zone, said case wall having one of said metallic bottom sheet members positioned thereadjacent, each of said metallic bottom sheet members of adjacently positioned furnace modules being coplanar with respect to one another; and D. a conveyor means extending sequentially entirely through said heating zones defined within said plurality of adjacently positioned furnace modules along the continuous microwave furnace for heating of articles transported therethrough, said transport means being positioned immediately above said metallic bottom sheet member and resting thereupon, said conveyor means including a transport belt oriented on a common plane with said metallic bottom sheet member mounted within said heating zones defined within each of said furnace modules, said conveyor means including a plurality of transport rollers defining a conveying plane common with said metallic bottom sheet members.

2. A continuous microwave furnace having a plurality of furnace modules forming heating zones arranged sequentially behind one another for heating articles conveyed therethrough as defined in claim 1 wherein said conveyor means includes a transport belt oriented on a common plane with said metallic bottom sheet member mounted within said heating zones defined within each of said furnace modules.

3. A continuous microwave furnace having a plurality of furnace modules forming heating zones arranged sequentially behind one another for heating articles conveyed therethrough as defined in claim 1 wherein said conveyor means includes a plurality of transport rollers defining a conveying plane common with said metallic bottom sheet member.

4. A continuous microwave furnace having a plurality of furnace modules forming heating zones arranged sequentially behind one another for heating articles conveyed therethrough as defined in claim 1 wherein said transport rollers define roller apertures therein to further enhance microwave radiation within said heating zones of said housing means.

5. A continuous microwave furnace having a plurality of furnace modules forming heating zones arranged sequentially behind one another for heating articles conveyed therethrough as defined in claim 1 further comprising support elements positioned within said heating zone in each of said furnace modules to support said metallic bottom sheet member thereabove.

6. A continuous microwave furnace having a plurality of furnace modules forming heating zones arranged sequentially behind one another for heating articles conveyed therethrough as defined in claim 1 wherein said hole means defined in said metallic bottom sheet member are positioned at a constant spatial distance R therebetween.

7. A continuous microwave furnace having a plurality of furnace modules forming heating zones arranged sequentially behind one another for heating articles conveyed therethrough as defined in claim 6 wherein said distance R between adjacent of said hole means is equal to a whole number times one-quarter of the wavelength of the microwave radiation of said corresponding microwave radiation source.

8. A continuous microwave furnace having a plurality of furnace modules forming heating zones arranged sequentially behind one another for heating articles conveyed therethrough as defined in claim 6 wherein said hole means is of a size equal to a whole number times one-quarter of the wavelength of the microwave radiation of said corresponding microwave radiation source.

9. A continuous microwave furnace having a plurality of furnace modules forming heating zones arranged sequentially behind one another for heating articles conveyed therethrough as defined in claim 4 wherein the distance between adjacent of said roller apertures is equal to a whole number times one-quarter of the wavelength of the microwave radiation of said corresponding microwave radiation source.

10. A continuous microwave furnace having a plurality of furnace modules forming heating zones arranged sequentially behind one another for heating articles conveyed therethrough as defined in claim 4 wherein said roller apertures are of a size being equal to a whole number times one-quarter of the wavelength of the microwave radiation of said corresponding microwave radiation source.

11. A continuous microwave furnace having a plurality of furnace modules forming heating zones arranged sequentially behind one another for heating articles conveyed therethrough as defined in claim 1 wherein said hole means defined in said metallic bottom sheet members are cross-shaped.

12. A continuous microwave furnace having a plurality of furnace modules forming heating zones arranged sequentially behind one another for heating articles conveyed therethrough as defined in claim 1 wherein said hole means defined in said metallic bottom sheet members are star-shaped.

13. A continuous microwave furnace having a plurality of furnace modules forming heating zones arranged sequentially behind one another for heating articles conveyed therethrough as defined in claim 1 wherein said hole means are positioned angularly displaced with respect to the transport direction of the conveyor belt.

14. A continuous microwave furnace having a plurality of furnace modules forming heating zones arranged sequentially behind one another for heating articles conveyed therethrough as defined in claim 1 wherein each of said housing casings includes a ring flange on each oppositely positioned end thereof and wherein each of said ring flanges includes a support extension means thereon.

15. A continuous microwave furnace having a plurality of furnace modules forming heating zones arranged sequentially behind on e another for heating articles conveyed therethrough as defined in claim 1 wherein said hole means include corners defined therein.

16. A continuous microwave furnace having a plurality of furnace modules forming heating zones arranged sequentially behind one another for heating articles conveyed therethrough as defined in claim 1 wherein said conveyor means includes an endless belt means which is microwave transparent and wherein said conveyor means further comprises:

A. a drive means;

B. a first turn-around roller rotatably movable with respect to said furnace modules and operatively secured to said drive means to be driven therefrom, said endless belt means extending around said first turn-around roller for movement therearound and to facilitate turning around of said endless belt means; and C. a second turn around roller rotatably movable with respect to said furnace modules and positioned spatially distant from said first turn-around roller, said endless belt means extending around said second turn-around roller to allow movement therewith and turn around of said endless belt means and to facilitate movement between said first turn-around roller and said second turn-around roller.

17. A continuous microwave furnace having a plurality of furnace modules forming heating zones arranged sequentially behind one another for heating articles conveyed therethrough as defined in claim 1 wherein each of said microwave radiation sources provided on each of said furnace modules are placed circumferentially staggered with respect to adjacent of said microwave radiation sources.

18. A continuous microwave furnace having a plurality of furnace modules forming heating zones arranged sequentially behind one another for heating articles conveyed therethrough as defined in claim 17 wherein said microwave radiation sources are circumferentially staggered at a constant angle with respect to adjacent of said radiation sources.

19. A continuous microwave furnace having a plurality of furnace modules forming heating zones arranged sequentially behind one another for heating articles conveyed therethrough as defined in claim 1 further comprising a first radiation absorber module placed adjacent one end of the adjacent furnace modules of the continuous microwave furnace and a second radiation absorber module placed adjacent the other end of the furnace modules of the continuous microwave furnace for containing of microwave radiation therewith and preventing of leaking thereof into the surrounding ambient environment.

20. A continuous microwave furnace having a plurality of furnace modules forming heating zones arranged sequentially behind one another for heating articles conveyed therethrough as defined in claim 1 wherein said first radiation absorber includes an absorber tunnel to further reduce microwave radiation leakage from said plurality of furnace modules.

21. A continuous microwave furnace having a plurality of furnace modules forming heating zones arranged sequentially behind one another for heating articles conveyed therethrough as defined in claim 19 further comprising a structural frame means having said furnace modules and said radiation absorber modules mounted on said structural frame means and wherein said endless belt means includes a first turn-around roller rotatably movable mounted on said structural frame means operatively secured to said drive means to be driven therefrom, said endless belt means extending around said first turn-around roller for movement therearound and to facilitate turning around of said endless belt means, and said endless belt means also including a second turn around roller rotatably movably mounted on said structural frame means and positioned spatially distant from said first turn-around roller, said endless belt means extending around said second turn-around roller to allow movement therewith and turn around of said endless belt means and to facilitate movement between said first turn-around roller and said second turn-around roller.

22. A continuous microwave furnace having a plurality of furnace modules forming heating zones arranged sequentially behind one another for heating articles conveyed therethrough, said continuous microwave furnace comprising:

A. a plurality of furnace modules positioned adjacent to one another to mutually define a heating area therealong, each of said furnace modules including:

(1) a housing means defining a heating zone therewithin;

(2) a housing casing secured to said housing means and including a case wall having a circular cross-sectional shape, said housing casing defining a radiation window means therein to facilitate entry of microwave radiation therethrough into said heating zone defined within said housing means;

B. a plurality of microwave radiation sources each being attached to one of said housing casings adjacent said radiation window means thereof and adapted to generate microwave radiation therein for transmitting through said radiation window means into said housing means thereadjacent for heating said heating zone therewithin, at least one of said microwave radiation sources being provided at said case wall;

C. a metallic bottom sheet member mounted within said heating zone of said housing means and defining a plurality of hole means therein for enhancing microwave radiation by secondary radiation therefrom within said heating zone, said case wall having one of said metallic bottom sheet members positioned thereadjacent, each of said metallic bottom sheet members of adjacently positioned furnace modules being coplanar with respect to one another; and D. a transport means extending sequentially entirely through said heating zones defined within said plurality of adjacently positioned furnace modules along the continuous microwave furnace for heating of articles transported therethrough, said transport means defining a conveying plane therein, said transport means being positioned immediately above said metallic bottom sheet member and resting thereupon, said conveyor means including a transport belt oriented on a common plane with said metallic bottom sheet member mounted within said heating zones defined within each of said furnace modules, said conveyor means including a plurality of transport rollers defining a conveying plane common with said metallic bottom sheet members.

23. A continuous microwave furnace having a plurality of furnace modules forming heating zones arranged sequentially behind one another for heating articles conveyed therethrough as defined in claim 22 wherein said metallic bottom sheet members include sheet position adjustment means for selective modification of positioning thereof.

24. A continuous microwave furnace having a plurality of furnace modules forming heating zones arranged sequentially behind one another for heating articles conveyed therethrough as defined in claim 22 wherein said housing casing defines air port means therein adjacent said radiation window means and further comprising an air control means operatively positioned adjacent said air port means for controlling movement of air therethrough.

25. A continuous microwave furnace having a plurality of furnace modules forming heating zones arranged sequentially behind one another for heating articles conveyed therethrough as defined in claim 22 further comprising a microwave distribution and deflection apparatus mounted within each of said furnace modules to provide further control of microwave radiation thereinto.

26. A continuous microwave furnace having a plurality of furnace modules forming heating zones arranged sequentially behind one another for heating articles conveyed therethrough as defined in claim 23 wherein each of said sheet position adjustment means within each furnace module are cooperatively interengaged in order to each provide approximately equal adjustment simultaneously.

27. A continuous microwave furnace having a plurality of furnace modules forming heating zones arranged sequentially behind one another for heating articles conveyed therethrough as defined in claim 22 wherein said metallic bottom sheet members include plane surfaces thereon.

28. A continuous microwave furnace having a plurality of furnace modules forming heating zones arranged sequentially behind one another for heating articles conveyed therethrough as defined in claim 22 wherein each of said metallic bottom sheet members includes a convexly domed surface thereon.

29. A continuous microwave furnace having a plurality of furnace modules forming heating zones arranged sequentially behind one another for heating articles conveyed therethrough as defined in claim 22 wherein each of said metallic bottom sheet members includes a concavely domed surface thereon.

30. A continuous microwave furnace having a plurality of furnace modules forming heating zones arranged sequentially behind one another for heating articles conveyed therethrough as defined in claim 22 wherein said microwave radiation source includes a radiation housing means which is positioned extending over said radiation window means, said radiation housing means defining an air exhaust means therein, the furnace further including a blower means positioned adjacent said air exhaust means and being operative to cool said microwave radiation source by blowing air thereadjacent through said air exhaust means.

31. A continuous microwave furnace having a plurality of furnace modules forming heating zones arranged sequentially behind one another for heating articles conveyed therethrough as defined in claim 30 further comprising an air regulator means positioned adjacent said air exhaust means for controlling the movement of air thereadjacent and therethrough.

32. A continuous microwave furnace having a plurality of furnace modules forming heating zones arranged sequentially behind one another for heating articles conveyed therethrough as defined in claim 31 wherein said air regulator means includes a sliding member for facilitating operation thereof.

33. A continuous microwave furnace having a plurality of furnace modules forming heating zones arranged sequentially behind one another for heating articles conveyed therethrough as defined in claim 32 wherein said air regulator means includes a rotating member for facilitating operation thereof.

34. A continuous microwave furnace having a plurality of furnace modules forming heating zones arranged sequentially behind one another for heating articles conveyed therethrough as defined in claim 25 wherein said microwave distribution and deflection apparatus includes a microwave deflector positioned at said radiation window means with at least two-dimensional deflection capability.

35. A continuous microwave furnace having a plurality of furnace modules forming heating zones arranged sequentially behind one another for heating articles conveyed therethrough as defined in claim 34 wherein said microwave deflect or has three-dimensional deflection capability.

36. A continuous microwave furnace having a plurality of furnace modules forming heating zones arranged sequentially behind one another for heating articles conveyed therethrough as defined in claim 33 wherein said microwave deflector is movably adjustable.

37. A continuous microwave furnace having a plurality of furnace modules forming heating zones arranged sequentially behind one another for heating articles conveyed therethrough as defined in claim 33 wherein said microwave deflector is formed of a flexibly resilient conductible metal material.

38. A continuous microwave furnace having a plurality of furnace modules forming heating zones arranged sequentially behind one another for heating articles conveyed therethrough as defined in claim 33 wherein said microwave deflector is formed of a variable conducting, partial absorbing, ceramic material.

39. A continuous microwave furnace having a plurality of furnace modules forming heating zones arranged sequentially behind one another for heating articles conveyed therethrough as defined in claim 33 wherein said microwave deflector is formed of a silicon carbide, ceramic encapsulated silicon carbide.

40. A continuous microwave furnace having a plurality of furnace modules forming heating zones arranged sequentially behind one another for heating articles conveyed therethrough as defined in claim 33 wherein said microwave deflector is formed of a ferrite material.

41. A continuous microwave furnace having a plurality of furnace modules forming heating zones arranged sequentially behind one another for heating articles conveyed therethrough as defined in claim 33 wherein said microwave deflector is formed of a glass material.

42. A continuous microwave furnace having a plurality of furnace modules forming heating zones arranged sequentially behind one another for heating articles conveyed therethrough as defined in claim 22 further comprising a wave guide channel means positioned on said housing casing and operative to receive microwave radiation from said microwave radiation source, said furnace module defining a plurality of indentation means extending therearound at partially adjacent said wave guide channel means for providing secondary microwave radiation therefrom.

43. A continuous microwave furnace having a plurality of furnace modules forming heating zones arranged sequentially behind one another for heating articles conveyed therethrough as defined in claim 42 wherein said indentation means extend along the entire length of said wave guide channel means to enhance generation of secondary microwave radiation therefrom.

44. A continuous microwave furnace having a plurality of furnace modules forming heating zones arranged sequentially behind one another for heating articles conveyed therethrough as defined in claim 42 further comprising an indentation tuning means for enhancing secondary microwave radiation from said indentation means.

45. A continuous microwave furnace having a plurality of furnace modules forming heating zones arranged sequentially behind one another for heating articles conveyed therethrough as defined in claim 44 wherein said indentation tuning means includes a slider member.

46. A continuous microwave furnace having a plurality of furnace modules forming heating zones arranged sequentially behind one another for heating articles conveyed therethrough as defined in claim 22 further comprising a wave guide channel means positioned on said housing casing and operative to receive microwave radiation from said microwave radiation source, said furnace module defining a plurality of indented hole means extending therearound at partially adjacent said wave guide channel means for providing secondary microwave radiation therefrom.

47. A continuous microwave furnace having a plurality of furnace modules forming heating zones arranged sequentially behind one another for heating articles conveyed therethrough as defined in claim 46 wherein said indented hole means extend along the entire length of said wave guide channel means to enhance generation of secondary microwave radiation therefrom.

48. A continuous microwave furnace having a plurality of furnace modules forming heating zones arranged sequentially behind one another for heating articles conveyed therethrough as defined in claim 46 further comprising an indented hole tuning means for enhancing secondary microwave radiation from said indented hole means.

49. A continuous microwave furnace having a plurality of furnace modules forming heating zones arranged sequentially behind one another for heating articles conveyed therethrough as defined in claim 48 wherein said indented hole tuning means includes a slider member.

* * * * *